United States Patent [19]

Frischknecht et al.

[11] Patent Number: 4,991,420

[45] Date of Patent: Feb. 12, 1991

[54] ROLLER NIP ADJUSTMENT DEVICE

[75] Inventors: Bruno Frischknecht; Rudolf Roder, both of Gwatt, Switzerland

[73] Assignee: Lauener Engineering AG, Thun, Switzerland

[21] Appl. No.: 237,240

[22] Filed: Aug. 26, 1988

[30] Foreign Application Priority Data

Aug. 26, 1987 [CH] Switzerland ..... 03276/87

[51] Int. Cl.[5] ..... B21B 31/02

[52] U.S. Cl. ..... 72/244; 72/248

[58] Field of Search ..... 72/248, 246, 244, 245

[56] References Cited

U.S. PATENT DOCUMENTS

| | | | |
|---|---|---|---|
| 1,762,292 | 6/1930 | George | 72/248 |
| 3,188,842 | 6/1965 | Bryan et al. | 72/248 |
| 3,339,393 | 9/1967 | Rice | 72/248 |
| 3,468,151 | 9/1969 | Diolot | 72/234 |
| 3,477,268 | 11/1969 | Schöffmann | 72/245 |
| 3,534,577 | 10/1970 | Fernbach | 72/248 |
| 3,626,740 | 12/1971 | Hinterhölzl | 72/244 |
| 4,076,069 | 2/1978 | Scheinecker et al. | 164/448 |
| 4,156,453 | 5/1979 | Scheinecker | 72/244 |
| 4,567,933 | 2/1986 | Lauener et al. | 164/428 |
| 4,649,986 | 3/1987 | Frischknecht et al. | 72/248 |
| 4,660,400 | 4/1987 | Potapov et al. | 72/214 |

FOREIGN PATENT DOCUMENTS

| | | | |
|---|---|---|---|
| 1224256 | 9/1966 | Fed. Rep. of Germany . | |
| 1758398 | 5/1968 | Fed. Rep. of Germany . | |
| 0125204 | 7/1984 | Japan | 72/248 |
| 971409 | 9/1964 | United Kingdom . | |

OTHER PUBLICATIONS

European Patent Search No. EP-88-81-0556, Nov. 25, 1988.

Abstract for DE 1,758,398.

*Primary Examiner*—Lowell A. Larson

*Assistant Examiner*—T. C. Schoeffler

*Attorney, Agent, or Firm*—Sheridan, Ross & McIntosh

[57] ABSTRACT

An apparatus for adjusting the roller nip in a stand for rolling and/or roll casting. In adjusting the roller nip, the first (lower) bearing housing remains substantially stationary while the second (upper) bearing housing pivots about a pivotal connection located in one of the outer recesses betweeen the first and second bearing housings. The roller nip adjusting means, which is located in the outer recesses between the first and second bearing housings opposite of the pivotal connection, supports a portion of the second bearing housing and can be used to apply a dynamic upward force on the second bearing housing which causes it to pivot and thereby increase the roller nip. The roller nip adjusting means can also be used to decrease the roller nip since when such means are retracted, gravitational forces will cause the second bearing housing to pivot downwardly and remain in indirect or direct contact with the roller nip adjusting means, thereby narrowing the roller nip. A pretensioning force is applied to the bearing housings to restrict widening of the roller nip when rolling stock.

27 Claims, 5 Drawing Sheets

ROLLER NIP ADJUSTMENT DEVICE

The invention relates to a stand for rolling and/or roll casting of metals and non-metallic materials, with a first, permanently attached bearing housing and a second bearing housing, adjustable to change a roller nip, said housings supporting the bearings of the rollers, and with recesses to receive the adjusting device for the nip being provided, said recesses being made in the outer area of the housing ends facing one another.

The conventional way of adjusting a roller nip is tensioning the rollers against the plates on the one hand or adjusting the rollers using a spindle or a hydraulic cylinder, tensioned in a roll stand. In the latter solution, the stretching of the roll stand always affects the nip, resulting in increased inaccuracy. Moving the rollers against fixed plates offers no opportunity for adjustment of the nip during operation.

Similar solutions can be provided using current technology by means of hydraulic electonic roller regulating systems. However, such systems are very cumbersome and expensive and are therefore out of the question for economic reasons, especially for roll casting installations.

German OS 26 46 388 teaches a billet guide for a casting installation with frame and/or stand parts located opposite one another and connected by tie rods, with the billet guide rollers mounted in said parts. The casting nip, in other words the distance between two casting rollers, is adjusted by inserting spacer plates and using them to control the distance between the bearing housings. Calibrated plates are required for an exact adjustment, adjusted to the various parts to be installed. Fine corrections as a rule must be made with thin shims. Correcting the casting nip during operation of the casting installation is completely impossible.

German OS 32 38 938 discloses a device for adjusting a nip formed by two rollers, especially a casting nip in a roll casting installation for making aluminum strips. The rollers are located in roller bearings surrounded by bearing housings. At least one of the bearing housings has at its corners opposite the other bearing housing, surfaces each of which is inclined at a certain angle to an axis, and which abut beveled surfaces of movable stops. The wedges are therefore movable in a direction vertical with respect to the roller axes.

The inventor has set himself the goal of creating a stand for rolling or roll casting of the type described above, which permits a further simplified adjustment of the roller nip for all types of stands, at least retains the stability, and with appropriately designed stands, creates opportunities for using electronic monitoring and control.

The goal is achieved according to the invention by virtue of the fact that in one of the recesses located opposite one another, means are provided for pivoting the second bearing housing about a rotational axis running parallel to the axes of the rollers, while in the other of the recesses opposite one another, means for adjusting the spacing of the bearing housing and hence the roller nip are disposed.

In contrast to known devices, therefore, the distance between the bearing housings and hence between the rollers is not changed by parallel displacement of the second or upper bearing housing, but by its adjustable swivelling about a rotational axis.

The bearing housing with the means according to the invention for adjusting the roller nip can be used in stands of all known designs, for example in closed stands or in stands for opening which can also have pretensioning devices. Stands according to German OS 32 38 936 have proven to be especially advantageous, and are described therein for strip molding machines. This stand operates according to the pretensioning principle, but with a frameless system.

When the bearing housings for the first and/or second roller—in the normal position lower and/or upper roller—are tensioned with respect to one another, the otherwise usual stretching of the frame will not suffice. This solution offers optimum and rigid definition of the roller nip.

The means for pivoting the second bearing housing around a rotational axis which is parallel to the axes of the rollers are preferably designed as follows:

at least one hinge, composed of a fork, a tongue, and a pin which is removable and mounted on bearings therein;

at least two interlocking cylindrical slide bearings or at least two interlocking spherical slide bearings located on both sides.

The means for changing the spacing of the bearing housings essentially correspond to known means which were previously mounted on both sides of the end faces of the bearing housings.

According to a first embodiment, interchangeable spacing plates are disposed in the corresponding recesses, preferably corner recesses.

These plates must be slightly convex on at least one side because a full-surface contact cannot always be provided because of the different pivot positions. For a fine adjustment, interchangeable shim plates can be added. Both spacing plates and shim plates are exactly calibrated. According to this first embodiment, the means for changing the spacing of the bearing housings—the spacing plates and/or shim plates—cannot be changed under tension so that automated maintenance is not possible. Therefore, in theory, even stands that are not pretensioned can be fitted or retrofitted according to the invention; however, these all suffer from the disadvantages mentioned above as far as expansion under the influence of force is concerned.

According to a second embodiment, the means for changing the spacing of the bearing housings relative to the axis of rotation of the second bearing housing can be tangentially acting spindles, rotatable by hand or by machine.

According to a third embodiment, the means for changing the spacing of the bearing housings can be in the form of a hydraulic electronic roller nip regulating system. Like the spindles mentioned above, these can be automated. A hydraulic electronic roller regulating system, however, is relatively cumbersome and expensive according to the current state of the art.

According to another version, mutually displaceable wedges with height adjustment are disposed in the corresponding recesses of the bearing housing in the direction of the axes of the rollers. It has been found especially advantageous to provide double wedges that are displaceable by a spindle with screw threads of opposite pitch, as described in German OS 32 38 938. Each of the two double wedges can be supported in a recess, especially a corner recess. By comparison with this proven embodiment in practice, the simplified embodiment according to the present invention becomes especially clear. Only one spindle running in the direction of the axes of the rollers with two double wedges need be rotated while, according to German OS 32 38 938, spindles on both sides of the end faces of the rollers and running transversely with respect to axes of the rollers are required, with double wedges that must be exactly adjusted to one another. If a separate spindle is provided in each bearing housing, the spindle can easily be connected to a shaft.

Finally, the means for changing the spacing of the bearing housings according to one of the above-mentioned versions can be flexible elements with a defined tension which generate a counterpressure to a pretension and are therefore partially compressed in the working position depending on the selected stiffness. This flexible element must be capable, when unloaded relative to the pretensioning, of lifting the upper roller with its bearings and bearing housing. The flexible elements, preferably composed of spring elements, transducers, or hydraulic elements, which are interchangeable, are designed according to the pretensioning pressure and magnitude of roller force as well as the desired adjustment range, and the charcteristics are defined accordingly.

The means for changing the spacing of the bearing housings can be mounted on the feed or discharge side of the stand and the means for pivoting the second bearing housing are correspondingly arranged.

The adjustable means for changing the spacing of the bearing housing are preferably capable of being monitored and controlled by means of devices for measuring the size of the roller nip and/or determining the strip thickness in an electronic control circuit.

The stand for rolling and for roll pressing is used for metals and nonmetallic materials such as rubber, paper, and plastics, especially thermoplastics.

The invention will now be described in greater detail with reference to the embodiments shown in the drawing.

Figure 1:
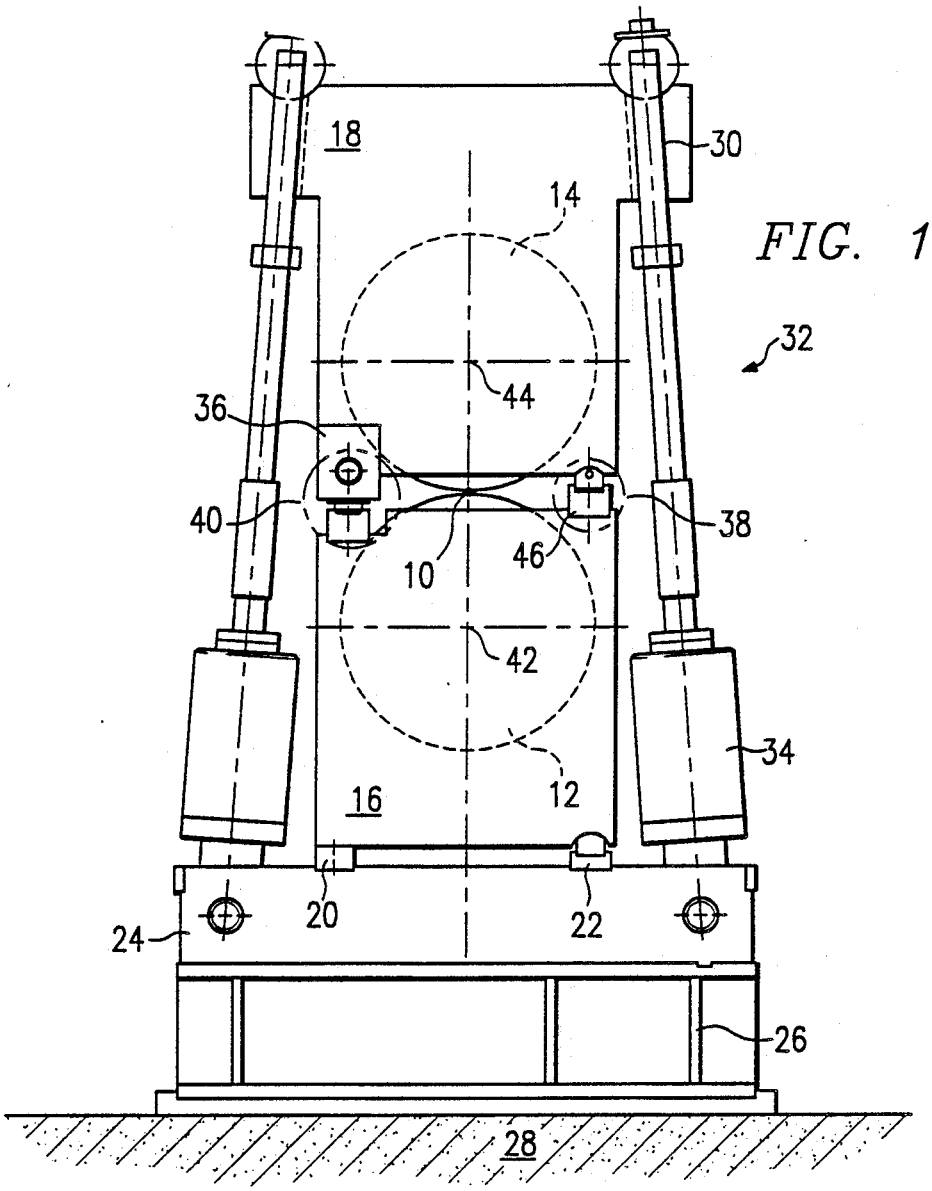
FIG. 1 is a partial cut-away view of a frameless pretensioned roll stand for strip casting of aluminum.

In the frameless stand of a roll casting machine according to FIG. 1, molten metal can be supplied from the left-or right-hand side from a nozzle not shown into the rolling and/or casting nip 10 between lower roller 12 and upper roller 14. These rollers are covered for the most part by the first, here the lower, bearing housing 16 and/or the second, here the upper, bearing housing 18.

First bearing housing 16 is located above a flat support 20 and a support 22 with centering on a baseplate 24, with the latter support being designed in known fashion for making "pass line" corrections. Baseplate 24 in turn is supported on base 28 by means of a frame support 26.

Second bearing housing 18 tapers toward the top in the manner of a yoke and receives on both sides cylinder rods 30 of a pretensioning device 32. The tension is generated hydraulically in cylinders 34, and the infrastructure required for this purpose and known of itself is not shown.

In recesses 36 of first and second bearing housings 16, 18, means 38, described in greater detail below, are mounted for pivoting the second bearing housing 18 about a rotational exis 46 that runs parallel to axes 42, 44 of rollers 12, 14. The number 40 is used to refer to the means shown in detail in the following figures and likewise disposed in recesses 36, for changing and /or adjusting the spacing of bearing housings 16, 18 and hence roller nip 10.

Figure 3:
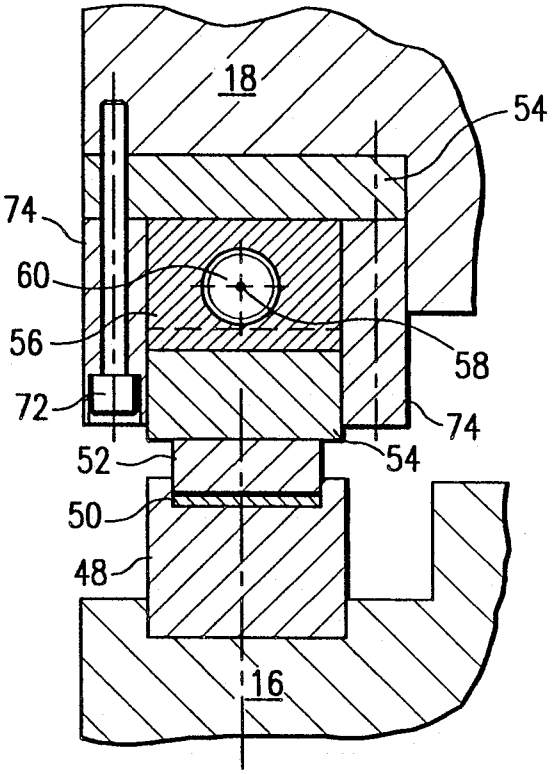
FIG. 3 is a section through FIG. 2 along line III—III.
Figure 2:
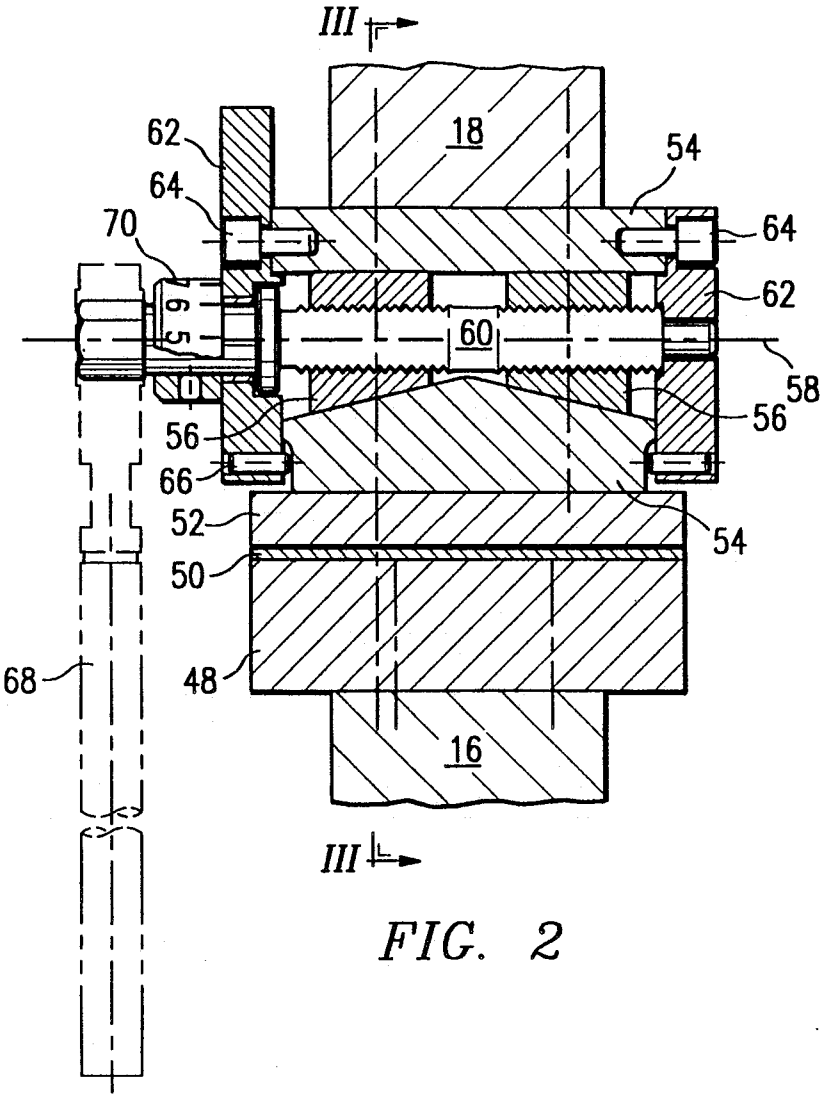
FIG. 2 is a vertical section with a partial view of a double wedge for adjusting the roller nip.

The embodiment shown in FIGS. 2 and 3, of a means 40 (FIG. 1) for adjusting the casting nip is fastened here in corner recesses of bearing Housings 16,18. A support plate 48 is mounted on the first, lower, bearing housing 16. On top is an interchangeable spacing plate 50 which at the top has a slight convexity, not visible in the drawings. By inserting spacing plates of different thicknesses, a coarse adjustment can be made which cannot be altered during the rolling and/or roll casting process. Of course, the spacing plate can be eliminated in marginal cases. Instead of spacing plate 50, coarse adjustments can also be made by using other means, for example, a likewise interchangeable flexible element in the form of a transducer or a mechanically or hydraulically acting spring element.

The intermediated plate 52 which rests on spacing plate 50 and/or directly on support plate 48 supports housing 54 for a double wedge 56 which in design and operation corresponds to the double wedge arrangement of German Patent 32 38 938. Axis 58 of spindle 60 according to the invention, however, does not run transversely with respect to axes 42, 44 of rollers 12 and 14, but parallel to them. The spindle has two helical threads with opposite pitch, so that wedges 56 can be moved toward or away from one another. The bottom surfaces of wedges 56 are completely flush with a correspondingly designed surface of housing 54 inclined at an angle $\alpha$. At the end, housing 54 for the double wedge is sealed off with a flange 62, said flanges being fastened to the housing by screws 64 and receiving pins 66 on the underside.

Threaded spindle 60 can be rotated by means of a manually operated ratchet 68, indicated by the dashed lines in FIG. 2. For fine adjustment, scale 70 may be read. The ratchet, however, can be replaced by an electric, hydraulic, or pneumatic drive of known design. This is particularly necessary for automated regulation.

Screw 72 serves to fasten the double wedge arrangement to second bearing housing 18. These screws 72 pass through the side walls 73 of housing 54.

Figure 4:
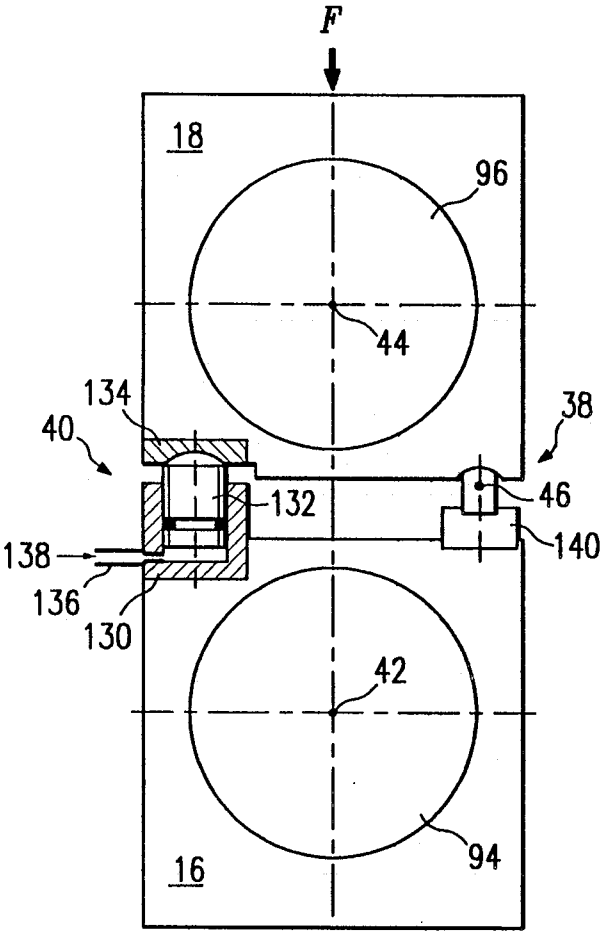
FIG. 4 is a partial cut-away view of two bearing housings with a hydraulic cylinder for pivoting the second bearing housing.

In the embodiment shown in FIG. 4, a cylinrical housing 130 with a piston 132 is disposed in a corner recess of lower bearing housing 16. On the convex piston rests a plate 134, disposed in the corresponding corner recess of upper bearing housing 18, with a concavely-shaped surface. By means of a tube stub 136 terminating in cylinder housing 130, a hydraulic medium 138, for example a plastic material, a grease, or a hydraulic oil, can be forced into the interior. For this purpose, for example, a known manually or motor-operated pump, not shown, is used.

Means 38 for forming rotational axis 46 consists of a convex-shaped support plate 140 located in the recess in lower bearing housing 16, said plate having a recess serving for centering. The support plate is disposed in upper bearing housing 18.

Each of the bearing housings 16 and 18 has a bore 94 or 96 to receive a roller pin.

Figure 5:
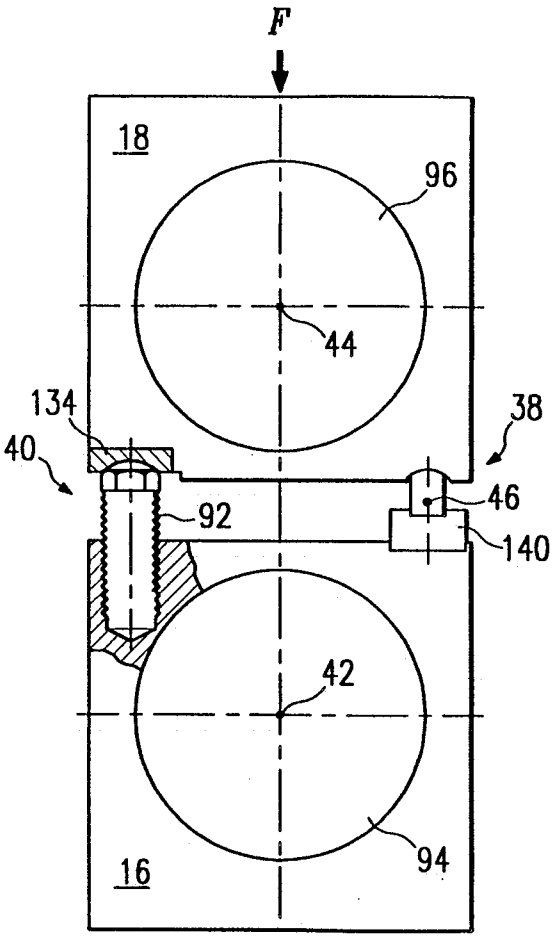
FIG. 5 is a partial cut-away view of two bearing housings with a tangentially acting spindle for pivoting the second bearing housing.

FIG. 5 shows another embodiment of means 40 for changing the spacing of bearing housings 16, 18 which comprises a spindle 92 which is perpendicular to axes 42, 44 of openings 94, 96 for the roller bearings and, which is rotatable by hand or by motor. Of course, spindle 92 as shown in FIG. 5 could exhibit the same characteristic as spindle 60 as shown in FIGS. 2 and 3 can also have two threads; the roller nip is then less finely adjustable for the same pitch of the thread.

Means 38 for forming rotational axis 46 correspond to those in FIG. 4.

Figure 6:
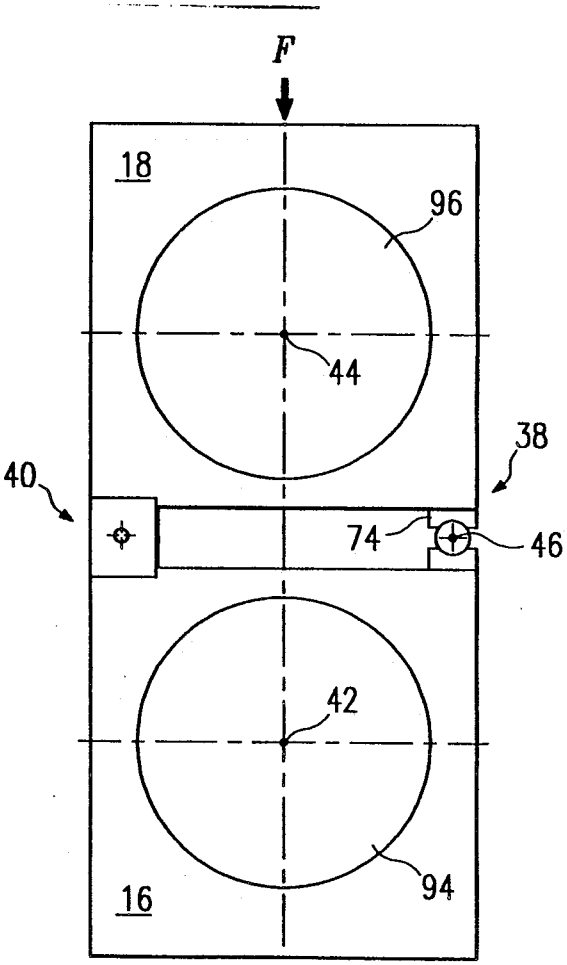
FIG. 6 is a partial cut-away view of two bearing housings with a hinge for pivoting the second bearing housing.

Hinge 74 shown in FIG. 6 for pivoting second bearing housing 18 essentially consists of a fork and a tongue which are traversed by a pin which is lockable in the lengthwise diretion. Particularly in the case of nonpretensioned stands, the pin has the minimum amount of play. The fork can be mounted on first or second bearing housing 16, 18, and the tongue correspondingly on the other.

Figure 7:
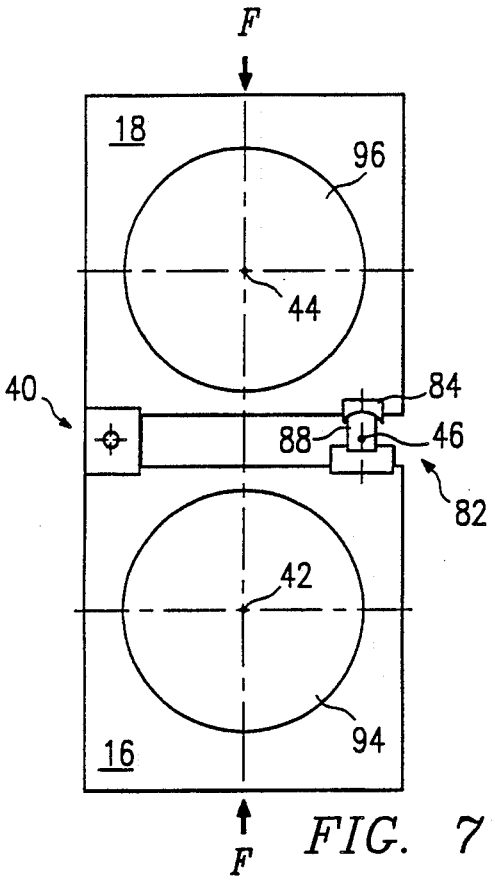
FIG. 7 is a partial cut-away view of two bearing housings with a cylindrical slide bearing for pivoting the second bearing housing.
Figure 8:
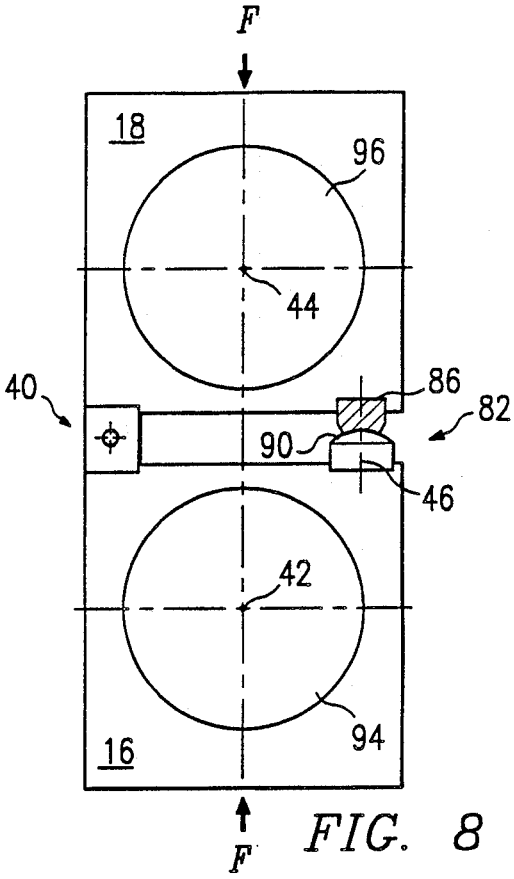
FIG. 8 is a partial cut-away view of two bearing housings with a spherical slide bearing for pivoting the second bearing housing.

In FIGS. 7 and 8, we see slide bearings 82 for pivoting second bearing housing 18, which have a bearing shell 84 with a cylindrical recess and/or a bearing shell 86 with a spherical recess. Matching element 88 and/or 90 has accordingly at least one partially cylindrical and/or spherically shaped surface. Depending on hinge 74 (FIG. 6), both types of individual parts can be fastened to both bearing housings 16, 18.

Figure 9:
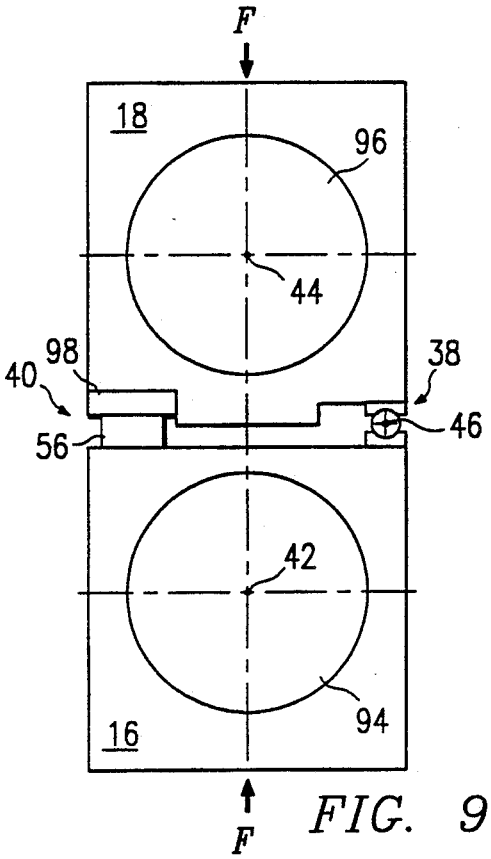
FIG. 9 is a partial cut-away view of two tensioned bearing housings with a hinge as a rotational axis and a combination of a spring unit with a wedge adjustment for changing the roller nip.
Figure 10:
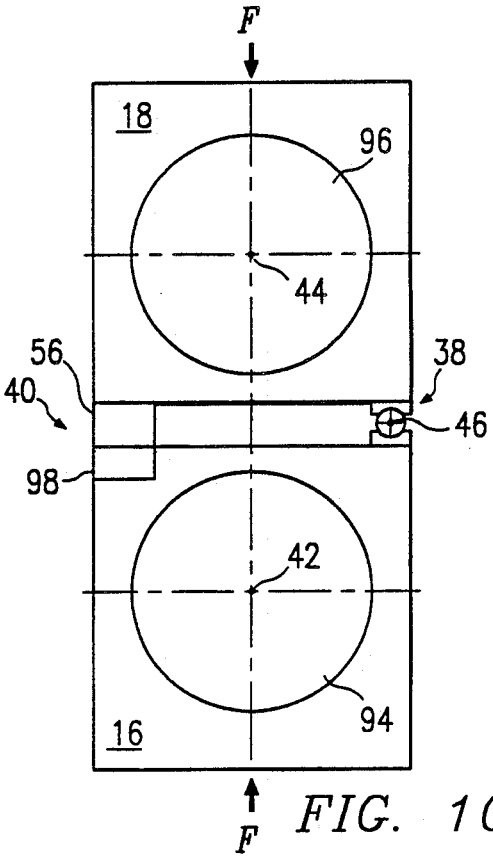
FIG. 10 is a version of FIG. 9 with a spring unit integrated into the bearing housing.

Bearing housings 16, 18 shown in FIGS. 9 and 10—likewise pretensioned with a force F—with opeingins 94, 96 for the roller bearings have special embodiments for means 40 which are merely indicated in FIGS. 6 to 8 for changing the roller nip.

Means 38 for pivoting second bearing housing 18 around the rotational axis 46 which runs parallel to roller axes 42, 44 are merely indicated; they correspond to FIGS. 4 to 8.

Means 40 for changing roller nip (10 in FIG. 1) consist of a spring unit 98 and a double wedge 56 according to FIGS. 2 and 3. Interchangeable spring unit 98 serves for coarse adjustment and double wedge 56, for fine adjustment.

The sping unit is partially compressed by pretensioning force F. However, the spring unit is strong enough that the upper roller with upper bearing housing 18 is lifted if the pretensioning force is removed.

In FIG. 10, spring unit 98 is integrated into lower bearing housing 16 and likewise serves for coarse adjustment. A double wedge 56 is again provided for fine adjustment.

The systems according to FIGS. 9 and 10 are especially well suited for automatic regulation, whereby pretensioning force F, double wedge 56, and possibly spring unit 98 can be adjusted under electronic control.

In these versions the advantages of the invention become especially clear:

It is possible to work with a very accurate roller nip and the expansion of a roll stand has no effect on the roller nip.

Economical pretensioning stands can be used.

All parameters can be coarse or fine adjusted under load.

Figure 11:
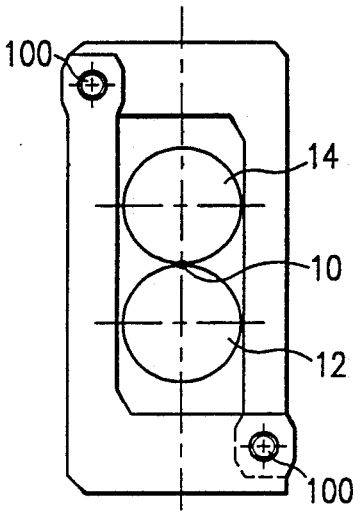
FIG. 11 is a schematic diagram of a stand for opening.
Figure 12:
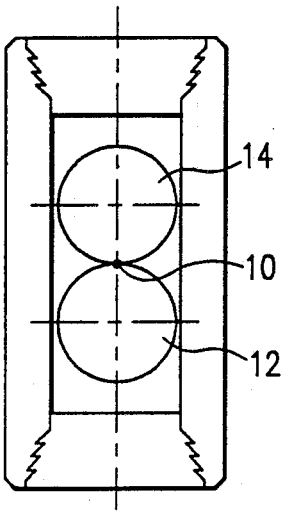
FIG. 12 is a schematic diagram of an assembled stand.
Figure 13:
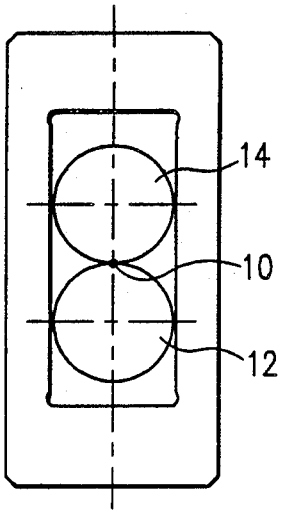
FIG. 13 is a schematic diagram of a closed stand.

A roller nip, once set, can be reset as often as desired, since the setting is not changed when the rollers are lifted. FIGS. 11 to 13 shown examples of stands with frames. The frame shown in FIG. 11 can be opened by removing at least one pin 100. The assembled stand in FIG. 12 can be disassembled by removing connecting bolts which are shown.

FIG. 13 shows a stand delimited by a closed frame. In all of the embodiments shown in FIGS. 11 to 13 known means not shown are used for fastening or pretensioning the bearing housings.

Figure 14:
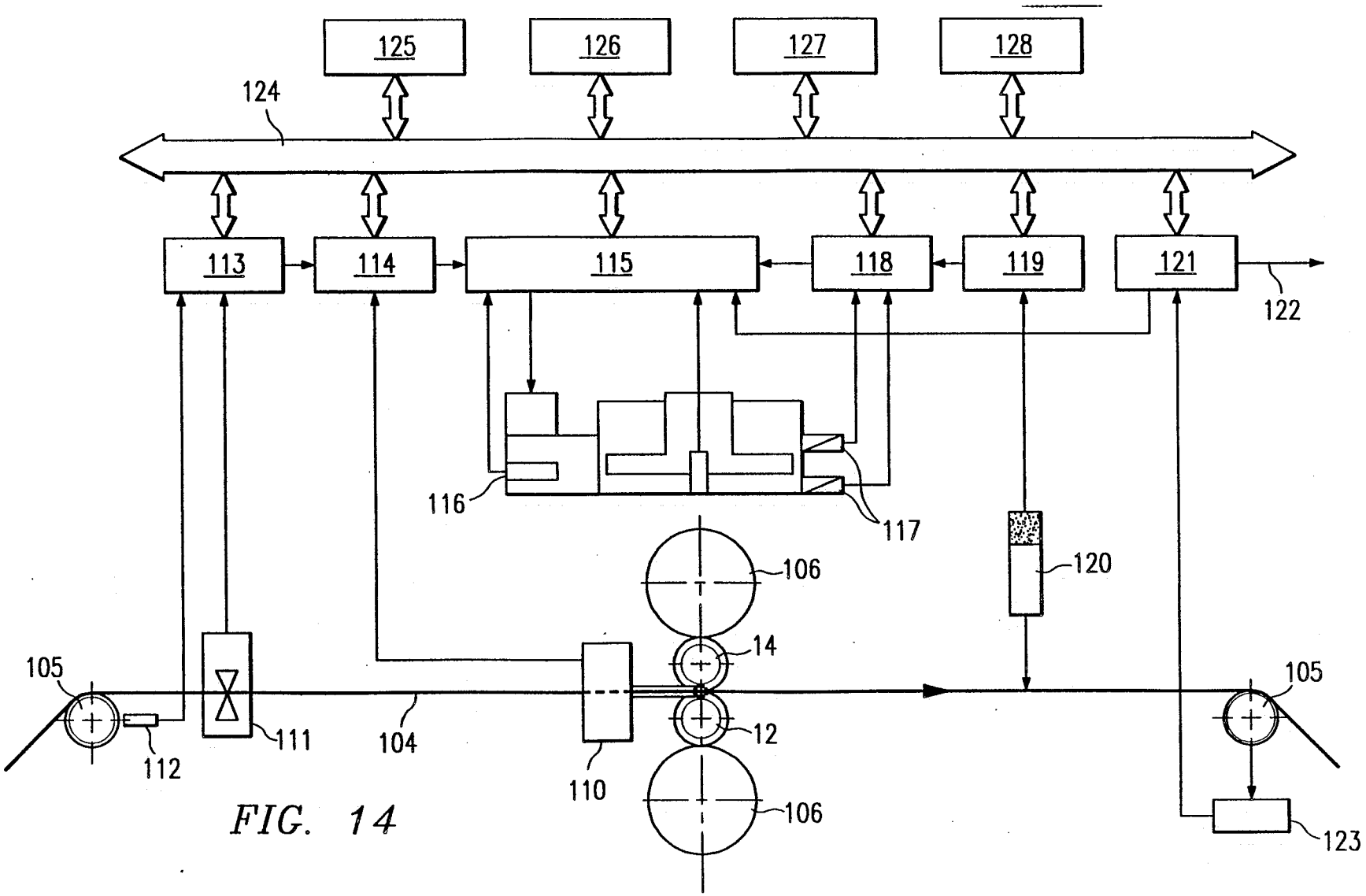
FIG. 14 is a block diagram of an integral hydraulic roller nip control.

FIG. 14 shows a standard control unit for rolling or roll casting frames which also incorporates the monitoring and adjustment of the casting nip by the adjustable means according to the invention.

Metal strip 104 of the rolling installation runs around return rollers through working rollers 12, 14, each supported by a support roller 106. As already mentioned, nonpretensioned stands or stands equipped with spacing plates cannot be used with a control unit as shown in FIG. 14.

The reference numbers shown in the drawings that refer to devices and/or installations known of themselves are as follows:

roller nip measuring device 110, strip thickness measuring device 111, strip speed measuring device 112, strip thickness regulator 113, roller nip regulator 114, position regulator 115, three-stage servo valve 116, transducer 117 (for hydraulic pretensioning), constant pressure regulator 118, skin pass control 119 with laser 120, strip thickness regulation by strip tension regulator 121, strip tension regulator 122, tension transducer for strip tension 123, address data and control bus 124, control and display panel 125, CPU 126, arithmetic processor 127, and EPROM RAM 128.

CONCLUSION

A stand for rolling and/or roll casting metals and nonmetallic materials comprises a first permanently mounted bearing housing (16) and a second bearing housing (18) which is adjustable for changing a roller nip (10). These housings support the bearings of rollers 12, 14. In the outer area of the end faces that face one another, recesses are provided to receive the adjusting device for the roller nip.

In one of the recesses (36) located opposite one another, means (38) are provided for pivoting second bearing housing (18) about a rotational axis (46) running parallel to axes (42, 44) of rollers (12, 14) while in the other of the recesses (36) opposite one another, means (40) are provided for adjusting the spacing of bearing housings (16, 18) and hence roller nip (10).

We claim:

1. In a stand useful for rolling or roll casting, said stand having a first bearing housing, in which a first roller having a first rotational axis is rotatably mounted, operatively connected to and spaced from a second bearing housing, in which a second roller having a second rotational axis is rotatably mounted, and a roller nip defined between the first and second rollers, the improvement comprising:

means for adjusting the spacing between the first and second bearing housings, at least a portion of said means for adjusting being positioned within the spacing between the first and second bearing housings in recesses of said first and second bearing housings, displaced from a surface coplanar with the first and second rotational axes, and capable of both increasing and decreasing the roller nip; and means for pivoting the second bearing housing relative to the substantially stationary first bearing housing to permit the spacing of the roller nip to change in response to said means for adjusting, said means for pivoting having a third rotational axis parallel with the first and second rotational axes, said means for pivoting being displaced from said surface coplanar with the first and second rotational axes, disposed across said surface from said means for adjusting and said means for pivoting being positioned in recesses of said first and second bearing housings.

2. The stand of claim 1, wherein:

the first bearing housing includes first and second recesses located on opposite sides of said coplanar surface and disposed adjacent tot the spacing between the first and second bearing housings;

the second bearing housing includes third and fourth recesses disposed adjacent to the spacing between the first and second bearing housings; and said first recess is aligned with said third recess, and said second recess is aligned with said fourth recess wherein said means for adjusting is operatively mounted within said first and third recesses while said means for pivoting is operatively mounted within said second and fourth recesses.

3. The stand of claim 1, wherein:

said means for adjusting includes means for determining the distance of the spacing between the first and second bearing housings.

4. The stand of claim 1, wherein:

said means for adjusting includes means for determining the thickness of a strip of material passing between the first and second rollers.

5. The stand of claim 1, wherein said means for adjusting includes:

a piston having a first section operatively mounted to the first housing and communicating with a hydraulic source, said piston having a second section abutting a portion of the second bearing housing; and means for actuating said piston to increase or decrease the spacing between the first and second bearing housings.

6. The stand of claim 1, wherein said means for adjusting includes:

a spindle being positioned perpendicular to the first and secon rotational axes, said spindle having a first section abutting the second bearing housing; and means for rotating said spindle thereby effecting one of increasing and decreasing the spacing between the first and second bearing housings.

7. The stand of claim 1, wherein:

said means for adjusting includes at least one interchangeable plate which is adapted to be either inserted or removed therefrom to provide adjustment.

8. The stand of claim 7, wherein:

said interchangeable plate includes a unilaterally convex spacing plate and a flexible thin shim plate.

9. The stand of claim 1, wherein said means for adjusting includes:

at least one wedge adapted to be displaced in both a forward direction and backward direction along a line which is substantially parallel to the rotational axes of said rollers, said displaceable wedge being positioned adjacent tot the second bearing housing such that the second housing is moved in one of an upward direction or a downward direction as a function of the wedge being moved in one of a forward direction or a backward direction; and actuating means operatively associated with said displaceable wedge for effecting movement of said wedge along said line.

10. The stand of claim 9, wherein:

said means for adjusting includes a second wedge disposed in opposing relation to said first wedge, said second wedge being positioned along the same plane as said first wedge, wherein the direction of motion of said second wedge is substantially parallel to or colinear with that of said first wedge; and said actuating means includes a spindle having first and second threads, said first and second threads having opposite pitch to one another and being operatively associated with said first and second displaceable wedges, respectively, such that said wedges are moved toward one another when said spindle is turned in a first direction and said wedges are moved away from one another when said spindle is moved in a second direction.

11. The stand of claim 1, wherein:

said means for pivoting includes a hinge.

12. The stand of claim 11, wherein said hinge includes:

a fork operatively mounted on one of the first bearing housing and second bearing housing;

a tongue operatively mounted on the other of the first bearing housing and second bearing housing; and a pin being received by said fork and said tongue along an axis parallel to the third rotational axis.

13. The stand of claim 11, wherein the hinge includes:

a bearing shell having a recess therein; and a matching element being pivotally received within the recess of said bearing shell.

14. The stand of claim 1, further comprising:

means for pretensioning the first and second bearing housings to provide a desired tension between said housings.

15. The stand of claim 14, wherein:

the first and second bearing housings are adjusted to said desired tension in a frameless stand.

16. The stand of claim 14, further comprising:

means for determining the distance of the spacing between the first and second bearing housings.

17. The stand of claim 14, further comprising:

means for determining the thickness of a strip of material passing between the first and second rollers.

18. The stand of claim 14, further comprising:

means for generating a force counter to said tension created by said means for pretensioning, said means for generating being capable of raising the roller operatively mounted within the second bearing housing when at least a portion of said tension is removed.

19. The stand of claim 18, wherein:

said means for generating includes a spring element.

20. The stand of claim 18, further comprising:

means for determining the distance of the spacing between the first and second bearing housings.

21. The stand of claim 18, further comprising:

means for determining the thickness of a strip of material passing between the first and second rollers.

22. The stand of claim 18, wherein:

said means for generating includes a transducer.

23. The stand of claim 18, wherein:

said means for generating includes a hydraulic element.

24. In a stand useful for rolling or roll casting, said stand having a first bearing housing, in which a first roller having a first rotational axis is rotatably mounted, operatively connected to and spaced from a second bearing housing in which a second roller having a second rotational axis is rotatably mounted, and a roller nip defined between the first and second rollers, the improvement comprising:

means for pretensioning the first and second bearing housings such that the same are adjusted to a desired tension;

first and second means for adjusting the spacing between the first and second bearing housings, at least portions of said first and second means for adjusting being positioned within the spacing between the first and second bearing housings, displaced from a surface coplanar with the first and second rotational axes, and capable of both increasing and decreasing the roller nip;

first and second means for pivoting the second bearing housing relative to the substantially stationary first bearing housing, said first and second means for pivoting having third and fourth rotational axes, respectively, each of said third and fourth rotational axes being parallel to the first and second rotational axes, said first and second means for pivoting being displaced from the surface coplanar with the first and second rotational axes and being disposed across said surface from said first and second means for adjusting, thereby permitting the spacing of the roller nip to change in response to said first and second means for adjusting;

the first bearing housing including first and second pair of recesses disposed adjacent to the spacing between the first and second bearing housings with said first pair being located on the opposite side of said coplanar surface from said second pair;

the second bearing housing including third and fourth pairs of recesses disposed adjacent to the spacing between the first and second bearing housings; and said first pair of recesses being aligned with said third pair of recesses and said second pair of recesses being aligned with said fourth pair of recesses, wherein said first and second means for adjusting are operatively mounted within said first pair of recesses and said third pair of recesses, while said first and second means for pivoting are operatively mounted within said second pair of recesses and said fourth pair of recesses.

25. The stand of claim 24, wherein each of said first and second means for adjusting includes:

at least one wedge adapted to be displaced in both a forward direction or a backward direction along a line which is substantially parallel to the rotational axes of said rollers, each of said displaceable wedges being positioned adjacent to the second bearing housing such that the second bearing housing is moved in one of an upward direction or a downward direction as a function of said wedge being moved in one of a forward direction or a backward direction; and actuating means operatively associated with each of said displaceable wedges for effecting movement of said wedge along said line.

26. The stand of claim 24, wherein:

means for generating a force counter to said tension created by said means for pretensioning said means for generating being partially compressed and capable of raising the roller operatively mounted within the second bearing housing when at least a portion of said tension is removed.

27. The stand of claim 24, wherein:

each of said first and second means for pivoting includes a hinge.

* * * * *

UNITED STATES PATENT AND TRADEMARK OFFICE

CERTIFICATE OF CORRECTION

PATENT NO. : 4,991,420

DATED : February 12, 1991

INVENTOR(S) : Bruno Frischknecht & Rudolf Roder

It is certified that error appears in the above-identified patent and that said Letters Patent is hereby corrected as shown below:

Column 1, line 21, delete "electonic" and insert therefor --electronic--.

Column 4, line 26, delete "exis" and insert therefor --axis--.

Column 4, line 34, delete "Housings" and insert therefor --housings--.

Column 4, line 47, delete "intermediated" and insert therefor --intermediate--.

Column 5, line 4, delete "cylinrical" and insert therefor --cylindrical--.

Column 5, line 28, delete "characteristic" and insert therefor --characteristics--.

Column 5, line 36, delete "diretion" and insert therefor --direction--.

Column 5, line 50, delete "opeingins" and insert therefor --openings--.

UNITED STATES PATENT AND TRADEMARK OFFICE

CERTIFICATE OF CORRECTION

PATENT NO. : 4,991,420

DATED : February 12, 1991

INVENTOR(S) : Bruno Frischknecht & Rudolf Roder

It is certified that error appears in the above-identified patent and that said Letters Patent is hereby corrected as shown below:

Column 5, line 63, delete "sping" and insert therefor --spring--.

Column 6, line 17, delete "shown" and insert therefor --show--.

Column 6, line 21, after "are" insert --not--.

Column 7, Claim 2, line 4, delete "tot" and insert therefor --to--.

Column 7, Claim 6, line 4, delete "secon" and insert therefor --second--.

Column 8, Claim 9, line 7, delete "tot" and insert therefor --to--.

Signed and Sealed this

Eighteenth Day of August, 1992

*Attest:*

DOUGLAS B. COMER

*Attesting Officer*

*Acting Commissioner of Patents and Trademarks*